United States Patent [19]

Imaizumi et al.

[11] Patent Number: 5,055,064

[45] Date of Patent: Oct. 8, 1991

[54] BRANCHING CONNECTOR FOR A SHIELDED CABLE

[75] Inventors: Haruo Imaizumi, Pulaza; Toshihiko Nishizawa, Yashirogaoka; Masatoshi Kato, Kagiyama, all of Japan

[73] Assignee: Junkosha Co., Ltd., Tokyo, Japan

[21] Appl. No.: 650,334

[22] Filed: Feb. 4, 1991

[51] Int. Cl.[5] ..... H01R 4/24

[52] U.S. Cl. ..... 439/402; 439/607

[58] Field of Search ..... 439/389–425, 439/578–585, 607–610

[56] References Cited

U.S. PATENT DOCUMENTS

| | | | |
|---|---|---|---|
| 3,573,713 | 4/1971 | Enright et al. | 439/402 |
| 3,804,971 | 4/1974 | Bazille, Jr. | 439/402 |
| 4,023,883 | 5/1977 | Raposa et al. | 439/402 |

*Primary Examiner*—Joseph H. McGlynn

*Attorney, Agent, or Firm*—Gary A. Samuels

[57] ABSTRACT

A branching connector for connecting a shielded bus cable with shielded branching cables by IDC connectors, the cables containing a multiplicity of insulated wires within each shield.

3 Claims, 4 Drawing Sheets

BRANCHING CONNECTOR FOR A SHIELDED CABLE

FIELD OF THE INVENTION

The present invention relates to branching connectors for connecting shielded electrical signal cables containing a multiplicity of insulated wires.

BACKGROUND OF THE INVENTION

In the past, connector systems for coaxial cables have been used as branching connectors for shielded cables. However, in the case of shielded paired wire cables, the branching operation cannot be performed in a simple manner and suitable connectors have not been available for branching shielded cables which contain a multiplicity of insulated wires.

SUMMARY OF THE INVENTION

The branching connector of the present invention is a branching connector for a shielded cable wherein the cable is formed by enclosing a multiplicity of insulated wires within a shield material. The branching connector has a casing that accommodates the branching portions of the bus cable and the terminal portions of the branching cable wherein the outer shell and shield material of each cable have been peeled away and the insulated wires are exposed. The casing contains positioning means for positioning the two ends of the branching portions of the bus cable and other positioning means for positioning the terminals of the branch cable. Conductive binders surround the shield material of the bus cable and the shield material of each branch cable. Insulation displacement contact (IDC) terminals connect the inner and outer conductive wires of each exposed insulated wire of the bus cables and the branching cables by severing the insulation coating thereof. The same members of the binders are interconnected and the same members of the terminals for connecting the insulated wires to be connected are interconnected.

In the connector of the present invention, the casing consists of a casing main body and a cap body. It is acceptable for the conductive binders and IDC terminals to be placed on the cap body. It is also acceptable for the cap body to consist of an outer cap (upper cap) and inner cap (lower cap) wherein the conductive binders are placed on the outer cap and the IDC terminals are placed on the inner cap. It is, of course, acceptable that IDC terminals that have interconnecting relationships be formed as a single integrated body.

In cases where the connector is used to connect the branching cable to the bus cable, the outer shell of the branching portion of the bus cable is first removed, the shield material is peeled away, and an end-portion treatment is performed on the two ends of the branching portions of the shield material. Afterward, the inner insulated wires are exposed. The same treatment is also performed on the end of the branching cable.

The ends of the branching portions of the bus cable and branching cable are then inserted into the casing of the connector and positioned therein. At the same time, the exposed insulated wires to be interconnected are grouped together and positioned in the casing.

The binders in the casing are then connected with the treated end portions of the shield material of the bus cable and the interconnected members of the binders and the same member of the IDC terminals for connecting the insulated wires are interconnected.

With this procedure, the shield material of the bus cable and the shield material of the branching cable are connected electrically, the insulated wires are connected, and the branching of the bus cable can then be completed.

BRIEF DESCRIPTION OF THE DRAHINGS

FIG. 1 shows a side view of the outer configuration of the connector of Example 1.

FIG. 2 is a cross-sectional view of the connector of FIG. 1 along cut line II—II.

Figure 3:
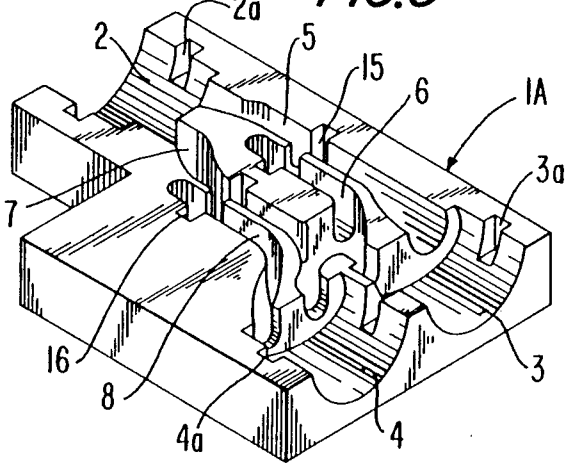

FIG. 3 describes the top of the casing main body.

Figure 4:
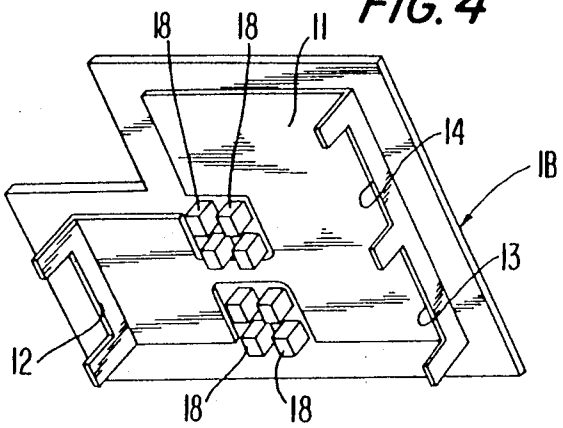

FIG. 4 shows a view of the bottom side of the upper cap.

Figure 5:
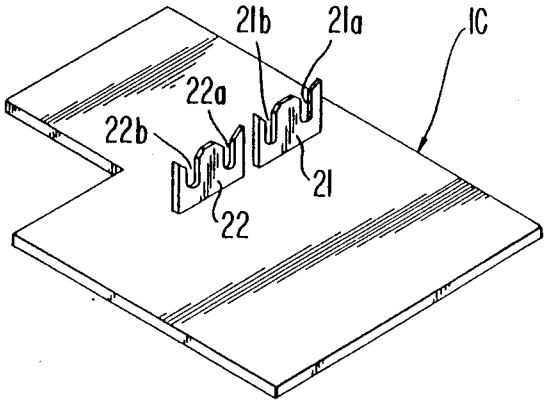

FIG. 5 shows a view of the top side of the lower cap.

Figure 6:
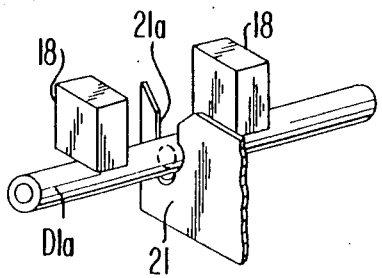

FIG. 6 describes the binding configuration between the IDC terminals and the insulated wires.

FIGS. 7–10 are drawings of Example 2 of the invention.

Figure 7:
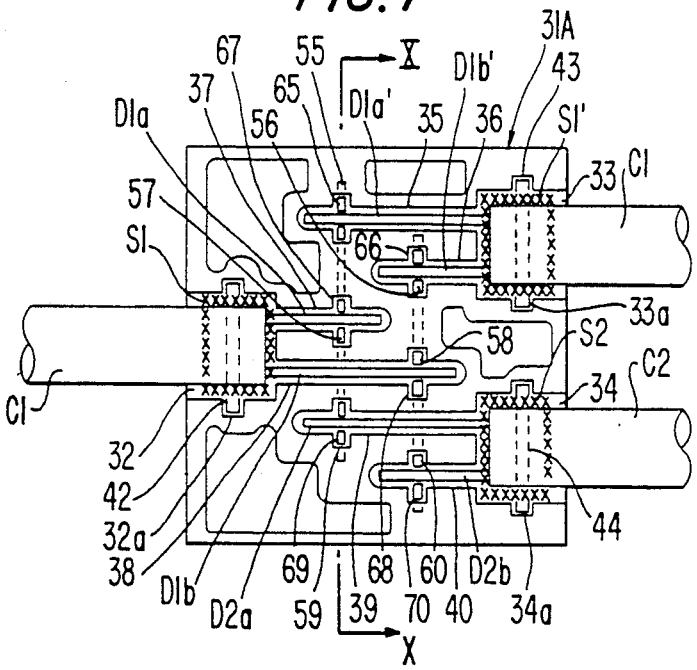

FIG. 7 is a diagram showing the internal structure of the connector covered with the upper cap.

Figure 8:
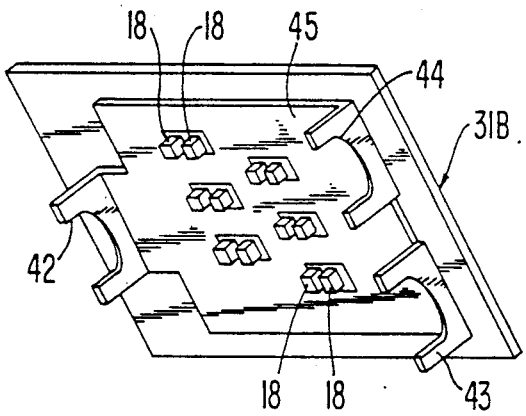

FIG. 8 shows the bottom side of the upper cap.

Figure 9:
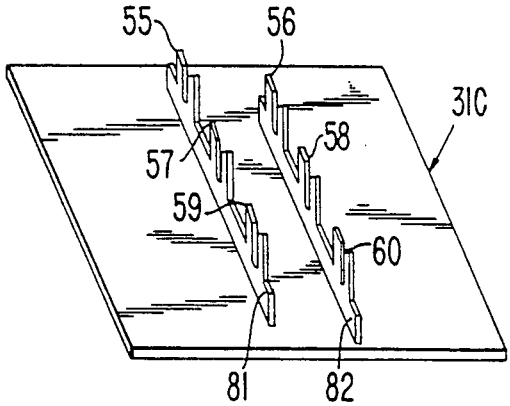

FIG. 9 describes the top side of the lower cap.

Figure 10:
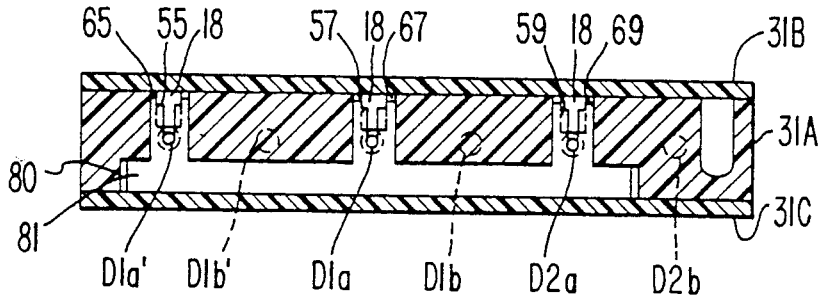

FIG. 10 is a cross-sectional view along cut line X—X of FIG. 7.

Figure 11:
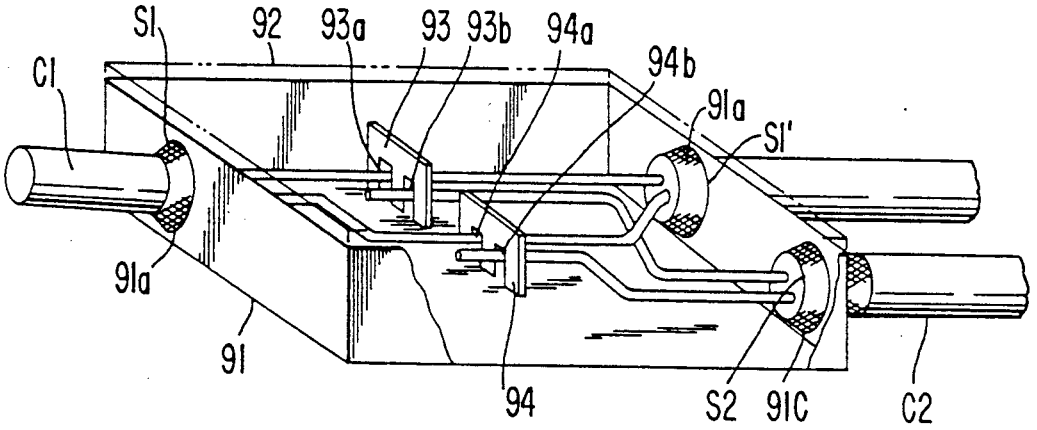

FIG. 11 is a schematic diagram of the cable of Example 3.

DETAILED DESCRIPTION

The invention is now described with reference to the examples and the figures to more clearly delineate the boundaries of the invention.

In the Examples, C1 and C1' are bus cables; C2 is a branching cable; D1*a*, D1*b*, D1*a'*, D1*b'*, D2*a* and D2*b* are insulated wires; S1, S1' and S2 are treated portions or ends of the shield material; 1 and 31 are casing; 1A, 31A and 91 are casing main body; 2, 3, 4, 32, 33 and 34 are female portions (positioning portions); 91*a*, 91*b* and 91*c* are openings in a positioning portion; 12, 13, 14, 42, 43, and 44 are binding terminal portions (binding portions); 21*a*, 21*b*, 22*a*, 22*b*, 93*a*, 93*b*, 94*a* and 94*b* are serrated blades for cutting through the coating of the insulated wire (IDC terminal); 55 to 60 are IDC terminals; 21, 22, 93 and 94 are IDC terminal plate; 81 and 82 are terminal plates.

FIGS. 1–6 apply to Example 1.

EXAMPLE 1

Figure 1:
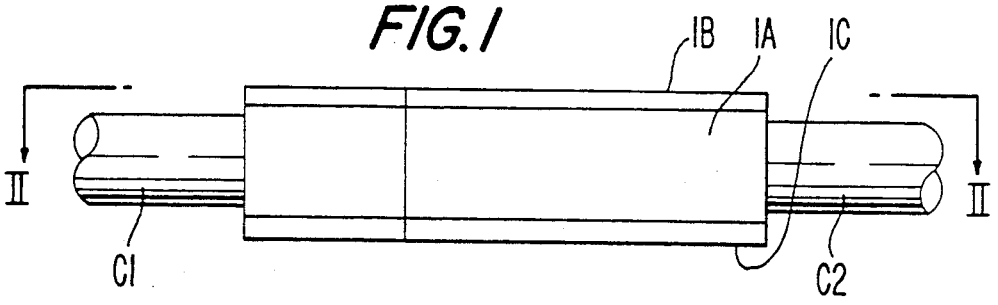
FIGS. 1–6 are drawings of Example 1 of the invention.
Figure 2:
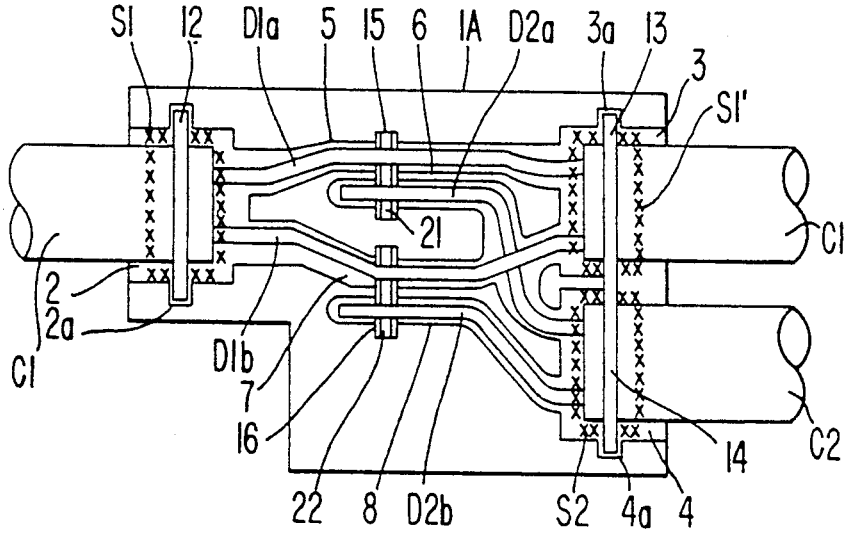

FIG. 1 shows that the branching connector M of Example 1 contains casing 1 which is made from a resin or polymer, for example, and the casing consists of the casing main body 1A, upper cap 1B and lower cap 1C. FIG. 2 shows the connecting configuration of the cables inside casing 1. In FIG. 2, C1 represents the bus cable that runs continuously from left to right and C2 represents the branching cable. The cables of C1 and C2 are shielded cables of the same type. The shielded cable consists of a pair of insulated wires D1*a* and D1*b* or D2*a* and D2*b*. The outside of the pair of insulated wires is surrounded with a shield material, and the outside of the shield material is wrapped with a resin or polymer shell.

The outer shells of the branching portion of bus cable C1 and the end of branching cable C2 are removed and the shield materials are peeled away. Afterward, the insulated wires D1*a*, D1*b*, D2*a* and D2*b* are exposed. Next, the branching portion of bus cable C1 and the end of branching cable C2 are inserted into predetermined positions in casing 1. The end portions of peeled shield materials S1 and S2 are wrapped onto the outer shell and a commonly-known end-portion treatment is then performed. In FIG. 2, the treated end portions of the shield materials are indicated by the notations S1, S1' and S2 (i.e. the portions are indicated with "x").

Casing main body 1A is a rectangular plate-like body with a thickness greater than the diameter of cable C1 or C2. The upper part of said casing main body consists of half-circle female parts 2, 3 and 4 (positioning portions) and connected guiding grooves, 5, 6, 7, and 8.

The female portions 2 and 3 are formed along the same straight line. The two ends of the branching portion of the bus cable C1 are positioned in said female portions 2 and 3. Accordingly, the two treated end portions S1 and S1' of the shield material of the branching portion of bus cable C1 are placed in female portions 2 and 3 as shown in FIG. 2. The female portions 4 and 3 are formed in a parallel manner. The end of branching cable C2 is positioned in female portion 4. Accordingly, treated end portion S2 of the shield material of the end of branching cable C2 is placed in female portion 4.

The insulated wires to be interconnected are placed in guiding grooves 5 and 6. Accordingly, guiding grooves 5 and 6 are placed next to each other. Next, insulated wire D1*a* of bus cable C1 is inserted into guiding groove 5, which is connected to female portions 2 and 3 as shown in FIG. 2 and insulated wire D2*a* of branching cable 2 is inserted into guiding groove 6, which is connected to female portion 4 as shown in FIG. 2.

The insulated wires to be interconnected are placed in guiding grooves 7 and 8. Accordingly, guiding grooves 7 and 8 are placed next to each other. Next, insulated wires D1*b* of bus cable C1 is inserted into guiding groove 7, which is connected to female portions 3 and 4 as shown in FIG. 2, and insulated wire D2*b* of branching cable 2 is inserted into guiding groove 8, which is connected to female portion 4 as shown in FIG. 2.

Grooves 2*a*, 3*a* and 4*a* are formed around the female portions 2, 3 and 4 in such a manner that binding terminal portions (binding portions) 12, 13 an 14 can be inserted into grooves 2*a*, 3*a* and 4*a*, as shown in FIG. 4. The binding terminal portions (binding portions) will be described below. Grooves 2*a*, 3*a* and 4*a* are respectively formed in a direction which is orthogonal to the axial lines of female portions 2, 3 and 4. Accordingly, cables C1 and C2 and binding terminal portions 12, 13 and 14 can be guided and positioned in an orthogonal manner.

A pair of parallel portions are formed in guiding grooves 5 and 6, and rectangular openings 15 are formed along the pair of parallel portions. Rectangular openings 15, which pass through the casing main body 1A in an up-down direction, are designed to accept the insertion of IDC terminal plate 21 (see FIG. 5). Rectangular openings 15 which have the shape of a slot are formed in such a manner that the length thereof is orthogonal with guiding grooves 5 and 6 and are cut in such a manner that the cutting traverses across grooves 5 and 6, cutting away the side walls of grooves 5 and 6 as shown in FIG. 3. As the two ends of IDC terminal plate 21 are caused to slide into the cut-away portions and IDC terminal plate 21 is inserted into rectangular openings 15, terminal plate 21 is guided and positioned orthogonally into guiding grooves 5 and 6.

Rectangular openings 16 for accepting the insertion of IDC terminal plate 22 are formed next to guiding grooves 7 and 8 in the same manner. Thus, as IDC terminal plate 21 is inserted into rectangular openings 16, IDC terminal plate 22 is guided and positioned orthogonally into guiding grooves 7 and 8.

FIG. 4 shows binding terminal portions 12, 13 and 14 used respectively to bind treated end portions S1 and S1' of the shield material of the branching portion of bus cable C1 and treated end portion S2 of the shield material of branching cable C2. Binding terminal portions 12, 13 and 14 are constructed in the form of a single integrated body on single metal plate 11. Accordingly, these binding terminal portions are interconnected. Single metal plate 11 containing binding terminal portions 12, 13 and 14 is fixed on the lower side of upper cap 1B.

Pressure-bonding terminal plate 21 shown in FIG. 5 is used to interconnect insulated wires D1*a* and D2*a* which are inserted respectively into guiding grooves 5 and 6 (the insulated wires D1*a* and D2*a* are wires to be interconnected). IDC terminal plate 21 contains two serrated blades 21*a* and 21*b* for connecting wires D1*a* and D2*a*. Serrated blade 21*a* is allowed to cut into insulated wire D1*a* in a manner shown in FIG. 6. As a result of said action, the resin coating of wire D1*a* is severed and the interior conductive wire and serrated blade 21*a* become interconnected. In order to obtain a desirable cutting effect, two pressing parts 18 are formed on upper cap 1B in a manner shown in FIG. 4 wherein pressing parts 18 can press against insulated wire D1*a* at each side of serrated blade 21*a*.

Meanwhile, IDC terminal plate 22 is used to interconnect insulated wires D2*a* and D2*b*, which are inserted respectively into guiding grooves 7 and 8 (insulated wires D2*a* and D2*b* are wires to be interconnected). IDC terminal plate 22 contains two serrated blades 22*a* and 22*b* for connecting wires D2*a* and D2*b*. IDC terminal plates 21 and 22 are fixed onto lower cap 1C.

It is acceptable for upper cap 1B, lower cap 1C, and casing main body 1A to be formed into a single integrated body by means of hinges.

The effects of the branching connector with the above structure are now described.

In cases where branching cable C2 is brought out from bus cable C1 using the connector with the above structure, the outer shell of the branching portion of the cable C1 is removed, the shield material is peeled away and an end portion treatment is performed on the shield material of the two ends of the branching portion. Afterward, interior insulated wires D1*a* and D1*b* are exposed. The end portion of branching cable C2 is also treated in the same manner. Afterward, insulated wires D2*a* and D2*b* are exposed.

The branching portion of bus cable C1 and the end of branching cable C2 are now housed and positioned into casing main body 1A. The two treated end portions S1 and S1' of the shield material of the branching portion of bus cable C1 are respectively placed into female portions 2 and 3, and treated end portion S2 of the shield material of branching cable C2 is placed into female portion S2. Exposed insulated wire D1*a* of bus cable C1 is inserted into guiding groove 5 and insulated wire D1*b* is inserted into guiding groove 7. Also insulated wire D2*a* of branching cable C2 for connecting with insulated wire D1*a* is inserted into guiding groove 6, and insulated wire D2*b* of branching cable C2 for connecting with insulated wire D1*b* is inserted into guiding groove 8.

Next, upper cap 1B is placed on the upper side of casing main body 1A. Accordingly, binding terminal portions 12, 13 and 14 placed on the lower side of the upper cap are respectively bound to treated end portions S1, S1' and S2 of the shield material. As a result, the shield material of bus cable C1 and the shield material of branching cable C2 are entirely inteconnected.

Lower cap 1C is now fixed to the lower side of casing main body 1A. Accordingly, pressure-bonding terminal plates 15 and 16 which have been integrated onto lower cap 1C are respectively inserted into rectangular openings 15 and 16 of casing main body 1A, and serrated blades 21*a*, 21*b*, 22*a* and 22*b* are respectively pressed onto insulating wires D1*a*, D2*a*, D1*b* and D2*b*. Insulated wires D1*a* and D2*a* are now conductively interconnected and insulated wires D1*b* and D2*b* are conductively interconnected. As lower cap 1C is fixed to the lower side of casing main body 1A, pressing parts 18 formed on upper cap 1B are fitted into guiding grooves 5, 6, 7 and 8. As a result, the insulated wires are pressed into place.

To summarize, the branching operation using the connector of the present example only involves positioning each cable into casing main body 1A and sequentially covering the casing main body with upper cap 1B and lower cap 1C as described above.

EXAMPLE 2

Example 2 is described in FIGS. 7–10.

This example shows a connector with which the members of the bus cable can be connected and branched. In FIG. 7, C1 and C1' are the bus cable and C2 is the branching cable. This example can also be conceived as an example wherein one cable is branched into two branched cables. For convenience, the connector of this practical example is defined as a connector with which the members of the bus cable can be connected and branched (C1 and C1' are the bus cable and C2 is the branching cable).

The connecting portions of bus cable C1 and C1' correspond to the branching portion of bus cable C1 of Example 1. The respective insulated wires D1*a*, D1*b*, D1*a*', D1*b*', D2*a* and D2*b* of the ends of cables C1, C1' and C2 are exposed and an end treatment is performed on the end portion of the shield material. The treated end portions of the shield material are shown by S1, S1' and S2.

Connector casing 31 consists of casing main body 31A shown in FIG. 7, upper cap 31B shown in FIG. 8, and lower cap 31C shown in FIG. 9. The female portions (positioning portions) 32, 33, 34, which correspond to female portions 2, 3 and 4 of Example 1, are formed on the upper side of casing main body 31A, as shown in FIG. 8. Female portion 32 is formed in the middle of the left end of casing main body 31A along the width direction, and female portions 33 and 34 are respectively formed in positions which are away from the middle of the right end of casing main body 31A along the width direction.

Grooves 32*a*, 33*a* and 34*a* are formed around the female portions 32, 33 and 34, respectively for guiding and positioning respective binding terminal portions (binding portions) 42, 43, and 44 placed on the lower side of upper cap 31B. Binding terminal portions 42, 43, and 44 are for interconnecting treated end portions S1, S1' and S2 of the shield material of cables C1, C1' and C2, and are formed on a single piece of metal plate 45 in an interconnected manner, as shown in FIG. 8. This single piece of metal plate 45, containing binding terminal portions 42, 43 and 44, is fixed on the lower side of upper cap 31B. The same pressing portions 18 used in Example 1, which are made of a resin or plastic, are placed on the lower side of upper cap 31B.

Guiding grooves 35, 36, 37, 38, 39 and 40 for guiding insulated wires D1*a*', D1*b*', D1*a*, D1*b*, D2*a* and D2*b* are formed in such a manner that the guiding grooves and female portions 32, 33 and 34 are connected, as shown in FIG. 7. All of these guiding grooves 35 to 40 run in a parallel manner. Respective rectangular openings 65, 66, 67, 68, 69 and 70, which are designed to accept the insertion of IDC terminals 55, 56, 57, 58, 59 and 60, shown in FIG. 9, are made along guiding grooves 35, 36, 37, 38, 39 and 40.

Rectangular openings 65, 67 and 69, which pass through guiding grooves 35, 37 and 39 used to interconnect the first group of insulated wires D1*a*', D1*a* and D2*a*, are aligned in one row, which is orthogonal to guiding grooves 35 to 40. These rectangular openings are tied together by means of groove 80 formed in the lower side of casing main body 31A in a manner shown in FIG. 10. Pressure-bonding terminals 55, 57 and 59 are interconnected. The base portion of terminal plate 81 is then inserted into groove 80 in a manner that allows the insertion of each of IDC terminals 55, 57 and 59 into each of rectangular openings 65, 67 and 69.

Remaining rectangular openings 66, 68 and 70 are aligned in one row, which is orthogonal to guiding grooves 35 to 40 at a location away from the row of rectangular openings, as shown in FIG. 7. IDC terminals 56, 58 and 60 for inserting into rectangular openings 66, 68 and 70 are formed on a single piece of terminal plate 82 in such a manner that IDC terminals 56, 58 and 60 are interconnected. Terminal plate 82 is then inserted into a groove that ties together rectangular openings 66, 68 and 70 (diagram omitted) in a manner that allows the insertion of each of the IDC terminals 56, 58 and 60 into each of the rectangular openings 66, 68 and 70.

IDC terminals 55 to 60 are respectively connected to insulated wires D1*a*', D1*b*', D1*a*, D1*b*, D2*a* and D2*b* in a (conductive) interconnecting manner shown in FIG. 7. These IDC terminals are fixed onto the upper side of lower cap 31C in the form of terminal plates 81 and 82.

The effects of the branching connector with the above structure for connecting each cable are now described.

First, the outer shells of the ends of cable C1, C1' and C2 are removed, the shield materials are peeled away, an end portion treatment is performed on the shield materials, and interior insulated wires D1*a*, D1*b*, D1*a*', D1*b*', D2*a* and D2*b* are exposed.

Next, the ends are housed into casing main body 31A and positioned respectively in designated locations. Namely, treated end portions S1 and S1' of the shield material of bus cables C1 and C1' are respectively placed into female portions 32 and 33, and treated end portion S2 of the shield material of branching cable C2 is placed into female portion 34. In addition, exposed insulated wire D1*a* of bus cable C1 is inserted into guiding groove 37 and exposed insulated wire D1*b* is inserted into guiding groove 38. Insulated wire D1*b* of the cable C1' (connected to the insulated wire D1*a*) is inserted into guiding groove 34 and insulated wire D1*b*' of the cable C1′ (connected to insulated wire D1*b*) is inserted into guiding groove 36. Insulated wire D2*a* of cable C2 (connected to insulated wire D1*a*) is inserted into guiding groove 39 and insulated wire D2*b* of cable C2 (connected to insulated wire D1*b*) is inserted into guiding groove 40.

Upper cap 31B is placed on the upper side of casing main body 1A. As a result, binding terminal portions 32, 33 and 34 (formed on the lower side of upper cap 31B) are respectively bound to treated end portions S1, S1′ and S2 of the shield materials, and all of the shield materials of cables C1 and C1′ and branching cable C2 are interconnected thereupon.

Lower cap 31C is fixed to the lower side of the casing main body 31A. This action leads to the respective insertion of IDC terminals 55 to 60 into rectangular openings 65 to 70 in casing main body 31A. The IDC terminals are formed on lower cap 31 as a single integrated body. As a result, pressure-bonding terminals 55 to 60 cut into insulated wires D1*a*′, D1*b*′, D1*a*, D1*b*, D2*a* and D2*b* situated in guiding grooves 35 to 40 and become connected to the insulated wires in such a manner that insulated wires D1*a*′, D1*a* and D2*a* and insulated wires D1*b*′, D1*b* and D2*b* are conductively interconnected. As lower cap 31C is fixed to the lower side of casing main body 31A, pressing parts 18 formed on upper cap 31B are fitted into guiding grooves 35 to 40 to press the insulated wires into place.

Summarizing, the branching operation using the connector of Example 2 only involves positioning each cable into casing main body 31A and sequentially covering the casing main body with upper cap 31B and lower cap 31C.

In Examples 1 and 2, metal plates 11 and 45 are placed on the inner surface of upper caps 1A and 31A in the form of a single integrated body and are configured in such a way that metal plates 11 and 45 act as a shield. A better interconnection with metal plate 11 or 45 can be obtained by placing or applying a metal plating onto the sides of casing main body 1A or 31A and/or lower cap 1C or 31C in a manner that the entire surface of the branching connector is covered with a shield material.

In Examples 1 and 2, binding terminal portions (binding portions) 12, 13, 14, 42, 43 and 44 are formed on upper cap 1B and 31B. It is also acceptable that metal plates be mounted onto positioning female portions 2, 3, 4, 32, 33 and 34 and that serrated materials, such as for binding the shield material (binding portions), are formed on the metal plates mounted on the female portions. When this configuration is used, all of the metal plates are connected. In Examples 1 and 2, casings 1 and 31 consist of main bodies 1A and 31A, upper caps 1B and 31B, and lower caps 1C and 31C. However, it is also acceptable that lower caps 1C and 31C be omitted by placing the IDC terminal plates on upper caps 1B and 31B.

EXAMPLE 3

Example 3 is also described in FIG. 11.

Next, another example is briefly described which concerns the branching connector shown in FIG. 11.

In this branching connector, casing main body 91 is made of a metal and the sides of the casing main body contain openings 91*a* and 91*b* (positioning portions) for bus cable C1 to pass through and opening 91*c* (positioning portion) for the insertion of branching cable C2. Serrated binders (binding portions) are formed around openings 91*a*, 91*b* and 91*c*. All of the shield materials can be interconnected by binding these serrated binders to treated end portions S1, S1′ and S2 of the shield materials.

Terminal plate 93 which contains serrated blades 93*a* and 93*b* (the cutting action of the serrated blades is equivalent to that of an IDC terminal) for cutting through the coating material of the insulated wires, and terminal plate 94, which contains serated blades 94*a* and 94*b*, is formed onto cap body 92.

In a procedure to connect branching cable 2 to bus cable C1, the branching portion of bus cable C1 and the end of branching cable C2 are treated in the same manner described in Examples 1 and 2. Bus cable C1 is then inserted through openings 91*a* and 91*b* of casing main body 91 and the end of branching cable C2 is inserted into opening 91*c*. Next, the serrated material around the openings is then used to bind treated end portions S1, S1′ and S2 of the shield materials. Afterward, the casing main body is covered with cap body 92. As a result, insulated wires D1*a* and D2*a* to be connected are conductively interconnected by terminal plate 93 and insulated wires D1*b* and D2*b* are conductively interconnected by terminal plate 94. Afterward, the branching operation is completed. It is also acceptable for terminal plates 93 and 94 to not be conductively connected to casing main body 91A in this configuration.

It is thus illustrated by Examples 1, 2 and 3 that shielded cables containing a multiplicity of insulated wires can be simply branched using the branching connector of the present invention.

We claim:

1. A branching connector for shielded cables comprising:

(a) a shielded bus cable consisting essentially of a multiplicity of insulated wires wherein each of said wires has a portion of said insulation removed to expose said wire;

(b) one or more shielded branching cables consisting essentially of a multiplicity of insulated wires wherein each of said wires in each of said cables has a portion of said insulation removed to expose said wire; and (c) a casing having a main body, a top cap and a bottom cap to accommodate said bus cable and said branching cables, said casing containing:

(i) positioning means for positioning said ends of said bus and branching cables on said casing;

(ii) a conductive binder bound to the shield material of each said bus and said branching cables;

(iii) insulation displacement contact terminals affixed to said casing whereon said insulation of said bus and said branching cables is severed to effect electrical contact between said wires of said cables and said contact terminals;

(iv) wherein said binders are interconnected and further are connected with the associated insulation displacement contact terminals which bear the wires to be interconnected.

2. A connector of claim 1 wherein said casing comprises a resin or polymer.

3. A connector of claim 1 wherein one or more of said bus and branching cables is coated with a protective outer jacket.

* * * * *